US007467762B1

(12) United States Patent
Parsons

(10) Patent No.: US 7,467,762 B1
(45) Date of Patent: Dec. 23, 2008

(54) ADVANCED UNMANNED AERIAL VEHICLE SYSTEM

(76) Inventor: John Charles Parsons, P.O. Box 151, Northport, WA (US) 99157

( * ) Notice: Subject to any disclaimer, the term of this patent is extended or adjusted under 35 U.S.C. 154(b) by 48 days.

(21) Appl. No.: 11/800,225

(22) Filed: May 3, 2007

Related U.S. Application Data

(63) Continuation of application No. 11/201,124, filed on Aug. 8, 2005, now abandoned.

(51) Int. Cl.
*F41G 7/30* (2006.01)
*F41G 7/00* (2006.01)
*B64D 17/00* (2006.01)

(52) U.S. Cl. ..... 244/3.14; 244/3.1; 244/3.11; 244/34 R; 244/35 R; 244/138 R; 244/142; 89/1.11

(58) Field of Classification Search ..... 244/3.1–3.3, 244/1 R, 53 R, 58, 62, 63, 138 R, 142–150, 244/151 R, 151 A, 151 B, 152, 117 R, 139, 244/137.1, 34 R, 35 R, 75.1, 76 R, 175, 189, 244/190; 89/1.11; 446/34, 49–54, 57, 58, 446/61, 63
See application file for complete search history.

(56) References Cited

U.S. PATENT DOCUMENTS 3,273,835 A * 9/1966 Holt et al. ..... 244/138 R
4,038,776 A * 8/1977 Filipeli ..... 446/52
4,884,769 A * 12/1989 Snead ..... 244/145
6,056,237 A 5/2000 Woodland
6,338,457 B1 * 1/2002 Hilliard et al. ..... 244/152
6,416,019 B1 * 7/2002 Hilliard et al. ..... 244/138 R
6,471,160 B2 * 10/2002 Grieser ..... 244/138 R
6,758,442 B2 * 7/2004 Bailey ..... 244/142
6,808,144 B1 * 10/2004 Nicolai et al. ..... 244/152
6,948,681 B2 * 9/2005 Stupakis ..... 244/117 R
2001/0048050 A1 * 12/2001 Grieser ..... 244/152
2002/0193914 A1 * 12/2002 Talbert et al. ..... 244/189
2003/0025038 A1 * 2/2003 Nicolai et al. ..... 244/152
2004/0196367 A1 10/2004 Raymond et al.
2005/0127242 A1 * 6/2005 Rivers, Jr. ..... 244/137.1

OTHER PUBLICATIONS

Julie Arnold, "Expandable Foam Impact Attenuation For Small Parafoil Payload Packages"; Version III Report, 16.621, Spring 2003; May 12, 2003; Massachusetts Institute of Technology; Cambridge, Massachusetts, USA; posted on the Internet at mit.edu.*

* cited by examiner

*Primary Examiner*—Bernarr E Gregory

(57) ABSTRACT

An Unmanned Aerial Vehicle (UAV) system that couples the speed and responsiveness of a shoulder-launched rocket with the stable, slow-moving aerial platform of a parafoil is disclosed. The unique use of an over-damped rocket automatically positions the parafoil upwind of its target and overcomes the inherent inability of the parafoil to make headway in adverse wind conditions. This marriage of a rocket and a parafoil creates a valuable new synergy that allows the rocket to very quickly position a payload at altitude and defeat any adverse winds, while the parafoil provides an inexpensive and easy-to-fly vehicle for reconnaissance or accurately placing a payload on a target. The system is suitable for aerial videography, thermal imagery, target designation, sensor placement or precision munitions delivery; and can perform these functions at a small fraction of the cost of any other UAV. Unlike other UAV's, no flying skills are required of the operator. The system is so simple to use that no special training is required even for flying at night, and the intrinsic stability of the parafoil eliminates the need for avionic control systems.

5 Claims, 7 Drawing Sheets

ADVANCED UNMANNED AERIAL VEHICLE SYSTEM

CROSS-REFERENCE TO RELATED APPLICATIONS

This is a continuation of application Ser. No. 11/201,124 filed 8 Aug. 2005, now abandoned.

FEDERALLY SPONSORED RESEARCH

Not Applicable.

SEQUENCE LISTING OR PROGRAM

Not Applicable.

BACKGROUND OF THE INVENTION

1. Field of Invention

This invention relates to an improved unmanned aerial vehicle system.

2. Discussion of Prior Art

Military forces have come to rely on Unmanned Aerial Vehicles (UAV's) to conduct reconnaissance and surveillance missions when those missions may endanger a flight crew and their aircraft.

Many aircraft types have been adapted for unmanned operation including fixed-wing, rotary-wing and lighter-than-air. Rotary-wing aircraft have proven unsatisfactory because of their high rate of energy consumption which limits range and payload capacity. They also have inherently high levels of vibration which causes problems for sensor payloads.

Lighter-than-air craft have been used as UAV's, largely as tethered surveillance aircraft. As they tend to be vulnerable targets and are slow to take up position, lighter-than-air UAV's have had very limited use.

Nearly all UAV's that have been operationally deployed are of the fixed-wing planform and are essentially large model airplanes with more robust construction. For example, AAI Corporation's "Pioneer™" (a trademark for unmanned aerial vehicles for AAI Corporation with a website aaicorp.com) was the first UAV to be fielded by the U.S. military (1986) and the same airframe configuration is still in use. Although tremendous advances have been made in UAV payloads (sensors, cameras, communication systems, etc.), and avionics (guidance and navigation); the aircraft for delivering these payloads have remained substantially unchanged for nearly twenty years.

Many UAV's designed on the fixed-wing planform have become so expensive they have begun to defeat one of their basic design functions: protecting expensive aircraft. This problem has become so pervasive that the more costly UAV's have been modified to carry so-called "parasite" UAV's. Parasite UAV's are small, inexpensive parafoil UAV's; such as those invented by Glen BAiley, STARA Technologies, Inc. (U.S. Pat. No. 6,758,442; filed Oct. 30, 2002 issued Jul. 6, 2004). Bailey's invention allows an expensive system such as "Pioneer™" to stay in a safe standoff position while the parasite UAV's are released to fly the last leg of a dangerous mission. The parasite UAV's are electronically controlled and directed to their targets.

Using a very expensive UAV to position an inexpensive one is not a satisfactory solution to cost problems. At least two inventions have been proposed as more affordable methods of utilizing parasite UAV's. One invention uses a mortar to loft the small parafoil UAV's to altitude. The other utilizes an artillery gun to launch the parafoil UAV's (vectorsite.net). Both these systems have common deficiencies. Both systems are only as accessible as the nearest mortar or howitzer. Additionally, howitzers and mortars require highly trained crews to operate them, just like the systems they propose to replace. They, too, need to be called in; just like the fixed-wing systems. Both systems also suffer because they induce tremendous G-forces on their payloads: as much as 17,000 G's for the artillery gun and 7,000 G's for the mortar. These ultra-high G-forces create engineering, construction and materials problems.

Still another invention called "SkyLite™" by an Israeli (a trademark of the company Raphael for unmanned aerial vehicles) company, Raphael, mentioned at vectorsite.net attempts to resolve the unresponsiveness problem of fixed-wing UAV's. This invention has a UAV with wings that close like scissors over the back of the fuselage. This allows the UAV to be launched from a tube mounted on a vehicle or carried and launched by a person. This is a complex invention with the concomitant considerations about durability and reliability. The complexity of this invention with the resultant high cost leave it at a competitive disadvantage. This is particularly true for non-military markets where "real-world" costs are often the single most important consideration. The "SkyLite" (a trademark of the company Raphael for unmanned aerial vehicles) is ejected from its launch tube and flies to altitude using an electric motor and pusher propeller, taking a significant time to reach altitude. Like its fixed-wing cousins, this invention cannot "place" sensors (or other payloads) on the ground or on a rooftop for example. It can only land where its specialized retrieval equipment is located.

In another attempt to solve the problem of slow response associated with the presently deployed UAV systems, Miniature Air Vehicles (MAV's) have been developed. MAV's are highly engineered and micro-miniaturized aircraft such as the invention of Woodland (U.S. Pat. No. 6,056,237; issued May 2, 2000). MAV's have not proven to be satisfactory as yet due to cost issues, reliability issues and durability issues. The over-riding problem with MAV's is their inability to carry useful sized payloads. The payload capacities of these systems range from a few grants to a few hectograms.

The Disadvantages of Present UAV Systems:

(a) They require delivery and setup time. They must be called-in, unpacked and assembled. This dramatically reduces their responsiveness.

(b) They require dedicated crews of three or four at the low end to as many as twenty or more to operate the large, sophisticated "Predator™" (a trademark of General Atomics Aeronautical Systems, Inc. for unmanned aerial vehicles) built by General Atomics Aeronautical Systems, Inc.

(c) Their operators require a high degree of specialized training to use each specific UAV system.

(d) The cost of these systems range from a high of $20 million for the aforementioned "Predator™" (a trademark of General Atomics Aeronautical Systems, Inc. for unmanned aerial vehicles) to a low of $250,000 for the "Raven™" (a trademark of AeroVironment, Inc. for unmanned aerial vehicles) built by AeroVironment, Inc. (Kerstein, "Boston Herald, May 11, 2005). These systems are expensive.

(e) In an attempt to make UAV's more readily available and quicker to deploy, they have been scaled down. For example, the aforementioned "Raven™" (a trademark of AeroVironment, Inc. for unmanned aerial vehicles) has a wingspan of only 4.5 feet. This small size, however, creates serious disadvantages. Small airfoils mean small payloads and shorter ranges.

(f) Fixed-wing UAV's take a lot of time getting to an operational altitude and can take considerable time going to their intended targets. Small fixed-wing UAV's are particularly slow, flying at only 20-60 mph. Large, powerful motors and the extra energy used by high speed flight are too heavy for small UAV's.

(g) When not in use, today's UAV's are burdensome at best and truly logistically problematic for the larger models. The smallest UAV widely deployed by U.S. forces to date takes three large backpacks to store and transport.

(h) Presently deployed UAV's cannot independently place sensors where they cannot land and they can land only in locations where there are specialized retrieval systems. Without these retrieval systems the UAV's essentially crash land.

OBJECTS AND ADVANTAGES OF THE PRESENT INVENTION

Accordingly, several objects and advantages of the present invention are:

(a) to provide a UAV that is readily available and requires no setup time, (b) to provide a UAV that needs no assembly in the field and is completely assembled at the factory, (c) to provide a UAV that is operable by one person, (d) to provide a UAV that is operable with little training, (e) to provide a more cost effective UAV, (f) To provide a small, light UAV that can carry payloads that until now could only be carried by large, heavy UAV's, (g) to provide a UAV that can be at high altitude in seconds, (h) to provide a UAV that can be over a target several miles away in seconds, (i) to provide a UAV that when not in use is small and light enough to be transportable by one person, (j) to provide a UAV that does not require special construction techniques or exotic materials, (k) to provide a UAV that flies slowly and lands gently enough to place sensor payloads in locations fixed-wing aircraft cannot, (l) and to provide a UAV that can land almost anywhere without specialized retrieval equipment.

Further objects and advantages will become apparent from a consideration of the ensuing description and drawings.

BRIEF SUMMARY OF THE INVENTION

Accordingly, the present invention is an unmanned aerial vehicle system comprising an electronically controlled parafoil and its payload lofted to altitude by a rocket. The parafoil, payload and rocket are stored in, transported in and launched from a tube; and fired from the shoulder by the operator. A unique structure that harnesses a phenomenon known as weather cocking allows the system to automatically position the parafoil upwind of the target.

BRIEF DESCRIPTION OF THE DRAWING FIGURES

DRAWINGS

Reference Numerals

| | |
|---|---|
| 10 | launch tube |
| 12 | firing switch |
| 14 | firing switch wiring |
| 16 | battery holder |
| 18 | leads |
| 20 | igniter |
| 21 | stop |
| 22 | rocket |
| 23 | aerodynamic feature |
| 24 | rocket motor exhaust nozzle |
| 25 | rocket motor |
| 26 | payload bay |
| 27 | payload section |
| 28 | parafoil compartment |
| 30 | fins |
| 32 | folded parafoil |
| 34 | flame-proof wadding |
| 36 | camera |
| 37 | battery |
| 38 | antenna |
| 39 | video camera transmitter antenna |
| 40 | controller motor |
| 41 | battery cable |
| 42 | control lines |
| 44 | suspension line mounts |
| 45 | control line apertures |
| 46 | suspension lines |
| 47 | aft payload bay bulkhead |
| 48 | aperture |
| 50 | radio receiver |
| 52 | electrical connection |
| 54 | parafoil |
| 56 | operator |
| 58 | wind speed and direction |
| 60 | expended rocket |
| 62 | trajectory of the rocket of the present invention |
| 64 | trajectory of a conventional rocket |
| 66 | parafoil ejection site of the present invention |
| 67 | parafoil ejection site of a conventional rocket |
| 68 | path of the parafoil of the present invention |
| 70 | path of the parafoil of a conventional rocket |
| 72 | target |

DETAILED DESCRIPTION

FIGS. 1-7—Preferred Embodiment

Figure 1:
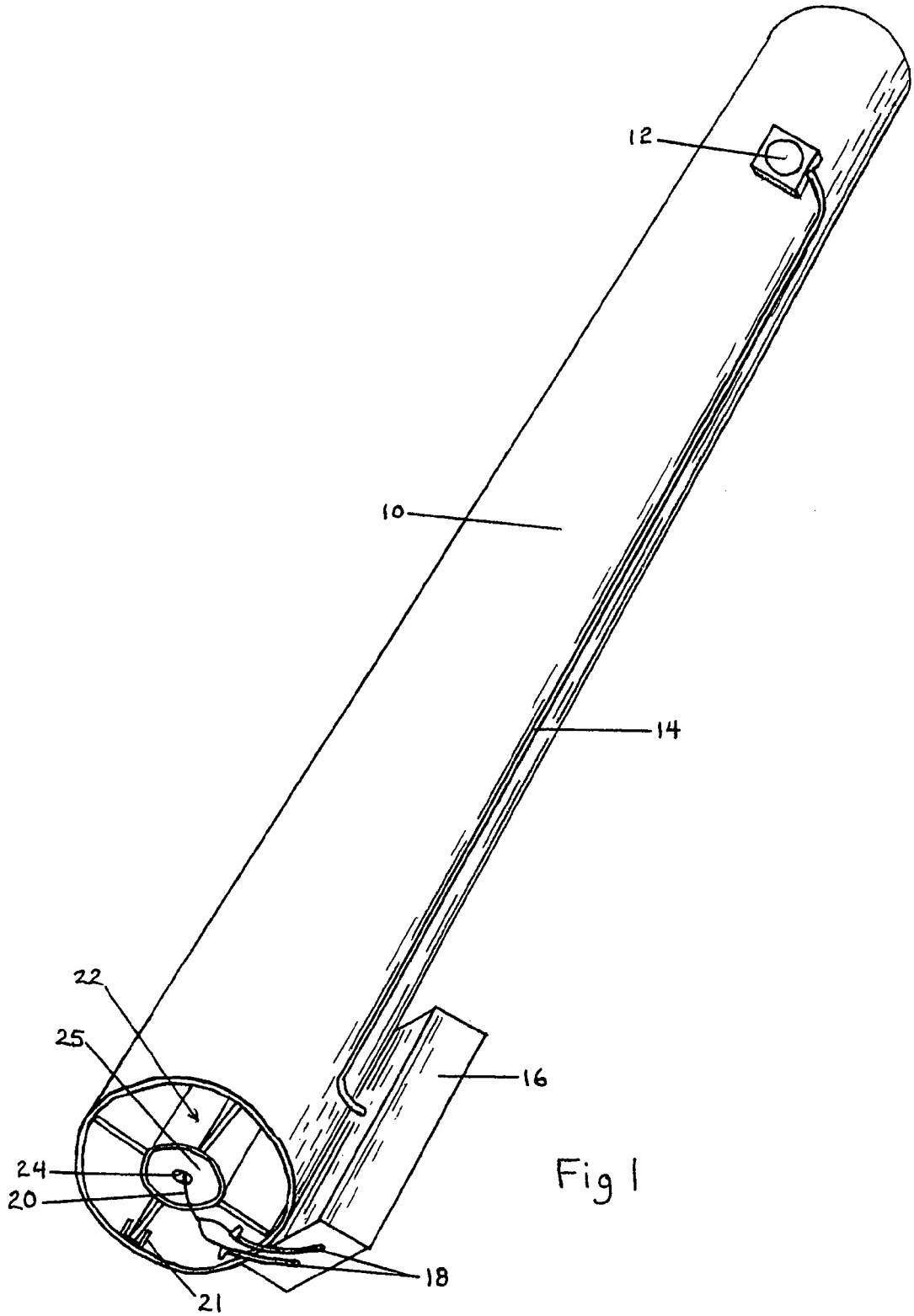
FIG. 1 shows an exterior view of the launch tube.

FIG. 1 shows a perspective view of a preferred embodiment of my UAV. In this basic version, a tube 10 is a container and a launcher for a rocket 22. The tube 10 is internally dimensioned to receive the rocket 22. A switch 12 is connected to a battery (not shown) in a battery holder 16 by firing switch wiring 14. A pair of electrical leads 18 connect the battery (not shown) in the battery holder 16 to an igniter 20 located in a rocket motor exhaust nozzle 24 at the aft end of a rocket motor 25. A stop 21 holds one of a set of four fins 30, securing the rocket 22 in the tube 10. (Note the large square area of the fins 30 which will be described at length below).

Figure 2:
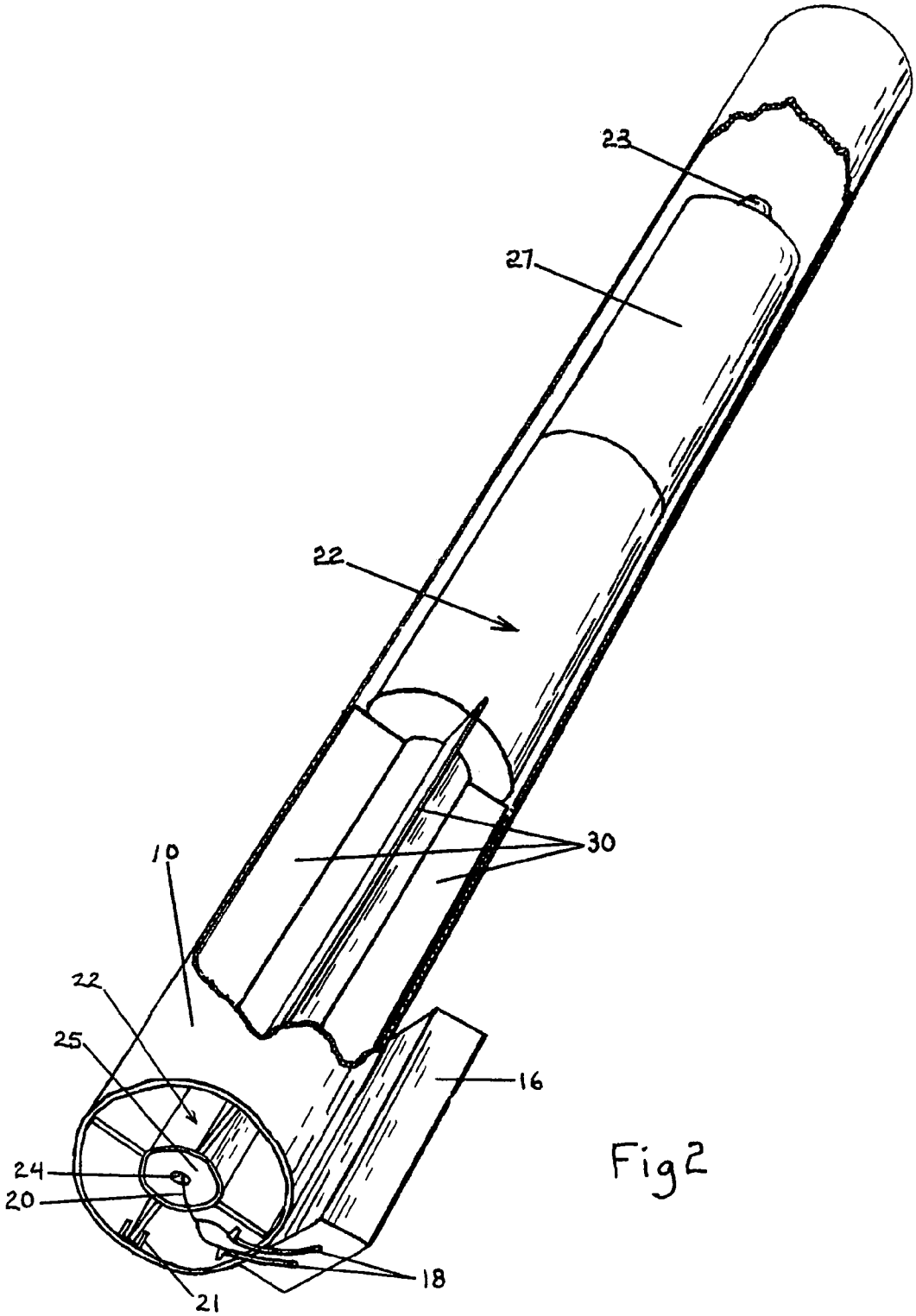
FIG. 2 shows a cutaway view of the launch tube and the rocket inside.

FIG. 2 is the same view as FIG. 1 with a cutaway revealing more of the rocket 22 including the extra large fins 30 and an aerodynamic feature 23 on the blunt nose.

Figure 3:
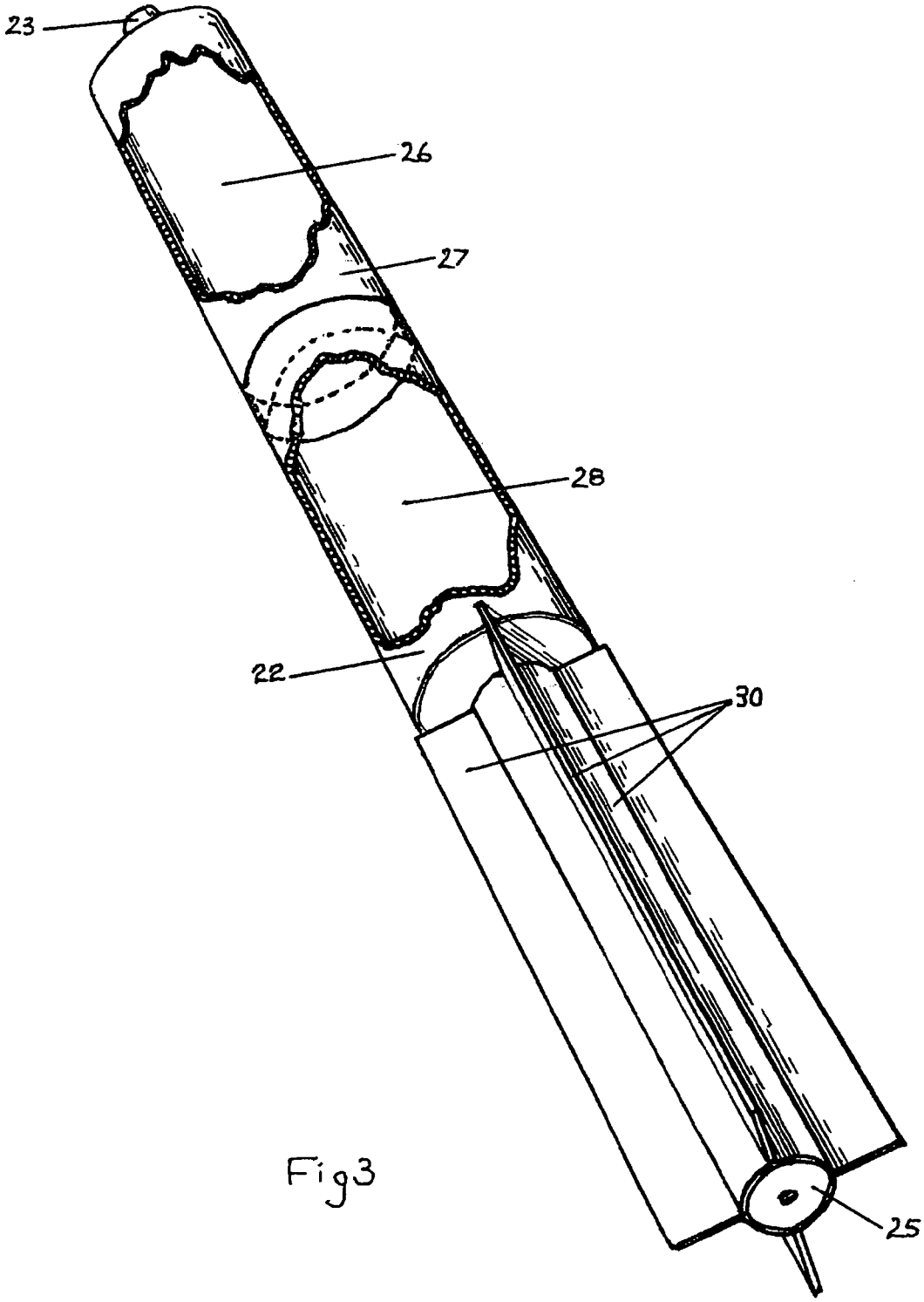
FIG. 3 shows the rocket with cutaways revealing the payload section and the parafoil compartment.

FIG. 3 shows a perspective view of the rocket 22 with cutaways revealing a payload bay 26 in the payload section 27 and a parafoil compartment 28. The aft end of the payload section 27 is dimensioned (i.e. sized down) to slide into the forward end of the parafoil compartment 28. This can be seen more clearly in FIG. 5.

Figure 4:
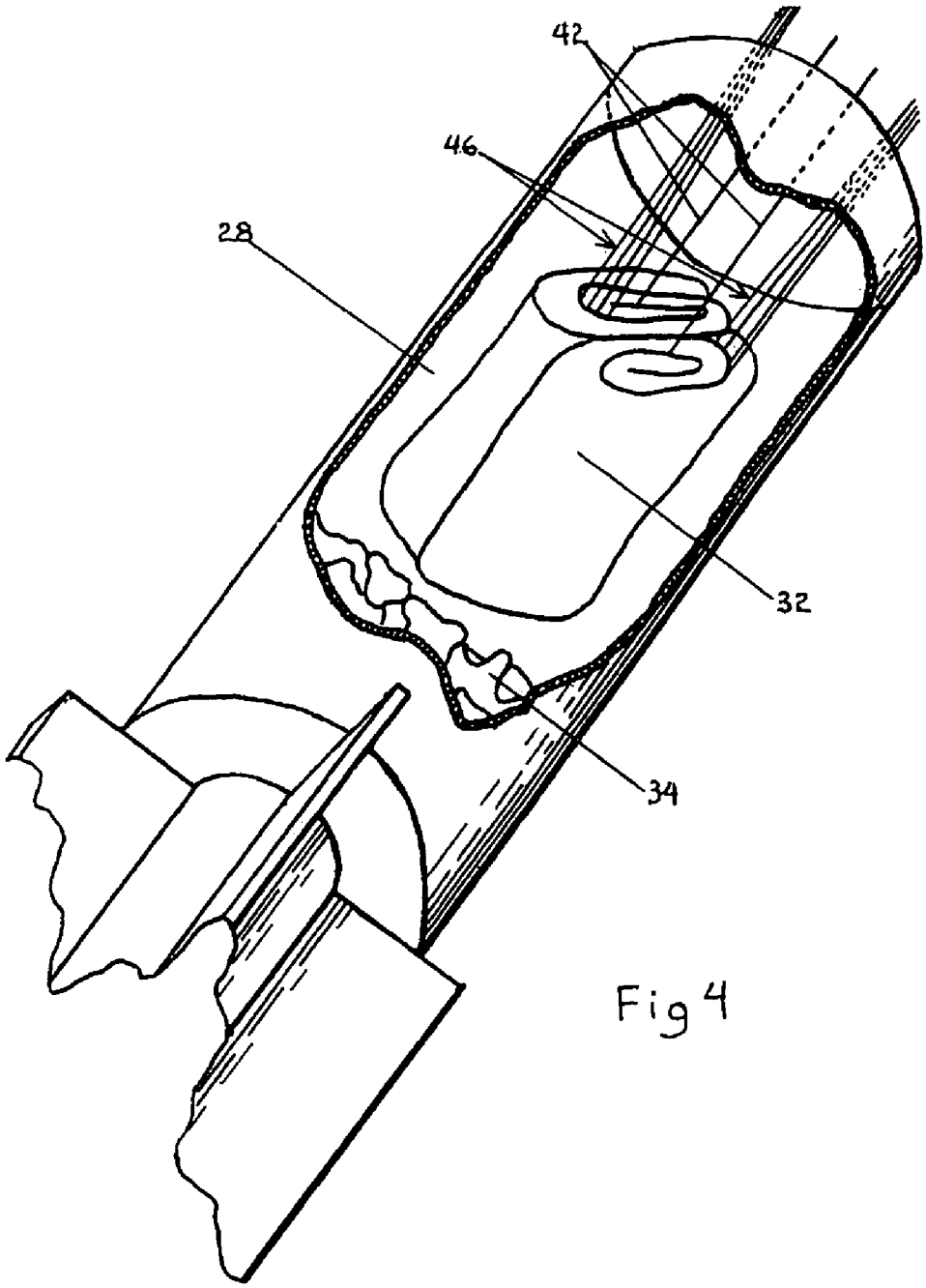
FIG. 4 shows the parafoil compartment with a cutaway showing the folded parafoil.

FIG. 4 shows the parafoil compartment 28 with a cutaway revealing a folded parafoil 32 above a layer of flameproof wadding 34. FIG. 4 also shows a plurality of suspension lines 46 and two control lines 42, all coming out from the folds of the folded parafoil 32.

Figure 5:
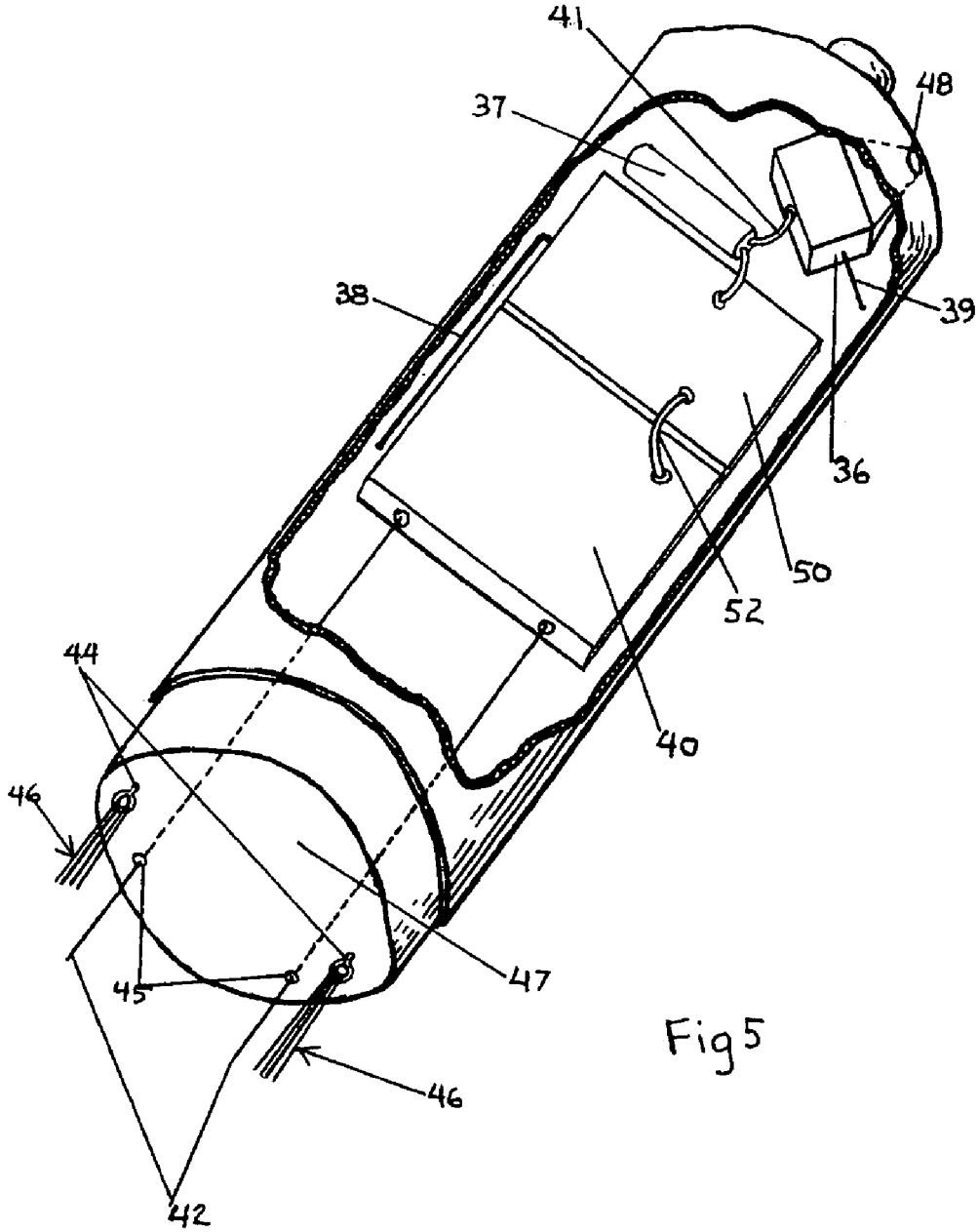
FIG. 5 shows the payload bay with a cutaway revealing a payload and the controller motor.

FIG. 5 shows the payload section 27 with a cutaway revealing the contents of the payload bay 26. A video camera 36 is aimed at an aperture 48 that allows light to reach the camera's lens. A battery 37 supplies power using battery cable 41. An antenna 38 is attached to a radio receiver 50. The receiver 50 is connected to a controller moter 40 by an electrical connection 52. The suspension lines 46 seen in FIG. 4 can be seen in their continuation here in FIG. 5. They are affixed to suspension line mounts 44 on the aft payload bay bulkhead 47. A pair of control line apertures 45 allows the control lines 42 to pass through the bulkhead 47 and connect to the controller motor 40.

Figure 6:
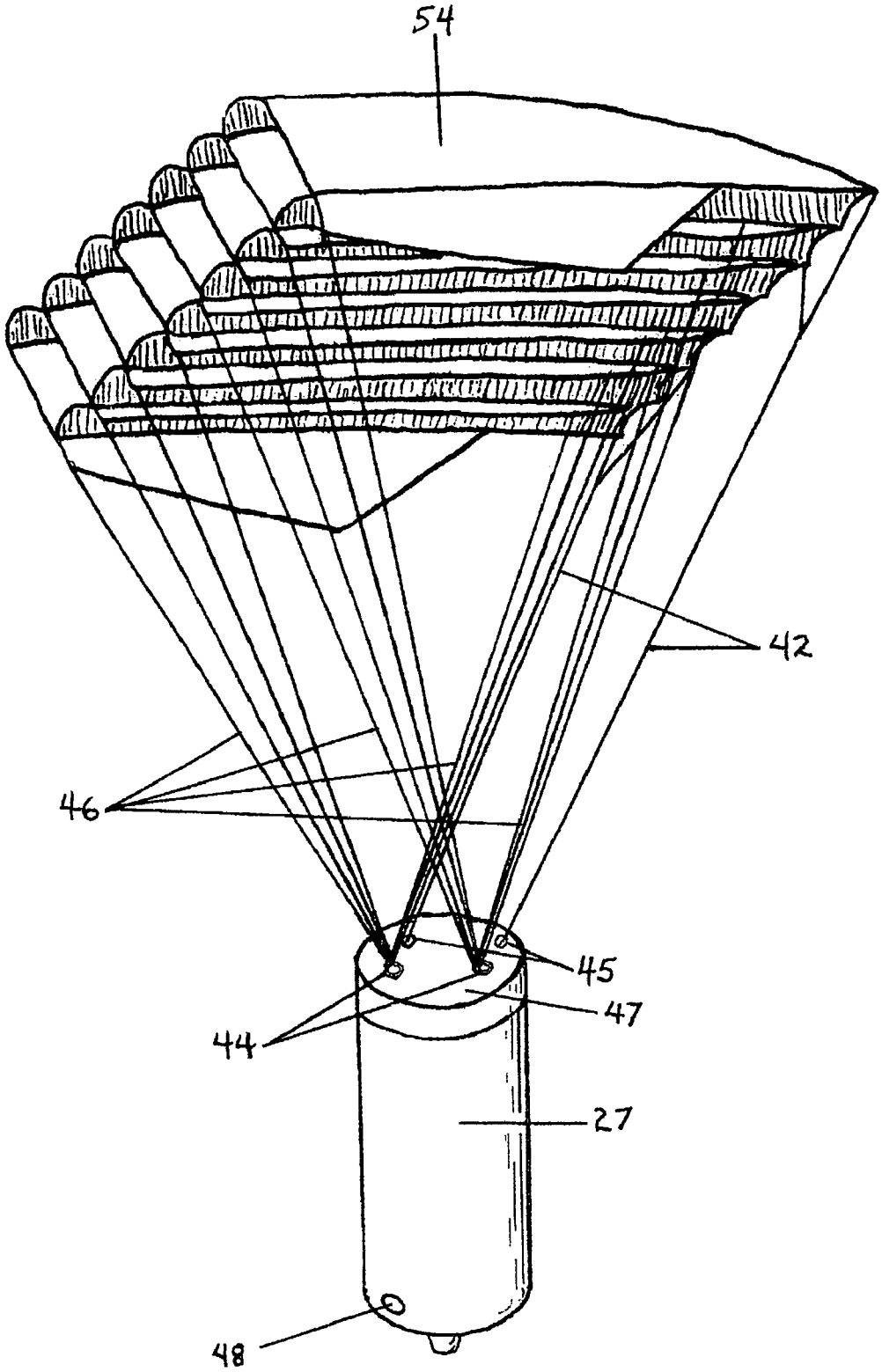
FIG. 6 shows a deployed parafoil and the payload section.

FIG. 6 shows a fully deployed parafoil 54 with the payload section 27 hanging from the suspension lines 46.

Figure 7:
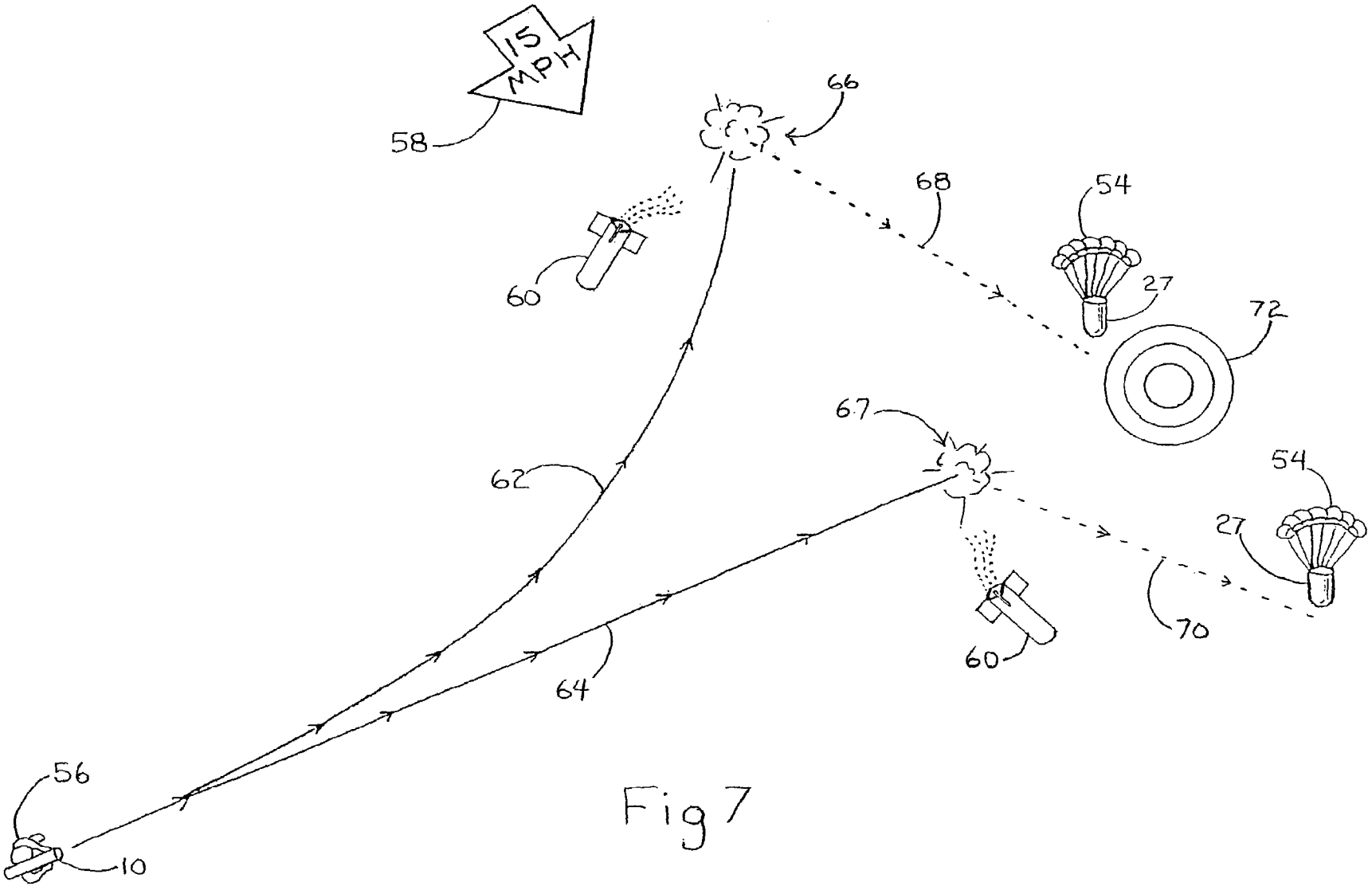
FIG. 7 shows the operation of the present invention in a 15 mph wind and its advantage over a conventional rocket system for positioning a parafoil for deployment.

FIG. 7 is an overhead view which shows an operator 56 upwardly aiming the launch tube 10 towards a target 72. An icon 58 indicates the wind speed and direction. The trajectory of the rocket of the present invention 62 is compared to the trajectory of a conventional rocket 64. The parafoil ejection sites 66 and 67 are shown for each respective rocket as well as the expended rocket 60. The path of the parafoil of the present invention 68 is shown for comparison to the path of the parafoil of a conventional rocket 70. For clarity, FIG. 7 shows a crosswind of 15 mph; however, the advantages of the present invention occur irregardless of the wind direction and over a wide range of wind velocities.

Theory of Operation—

A brief discussion of the Theory of Operation of the present invention will facilitate an understanding of the "Operation" section that follows below.

The first prototype of the present invention utilized fixed fins. Ordinarily, modern tube-launched rockets use some form of folding-fin design. This greatly reduces the needed diameter of the launch tube. Because of the experimental nature of the early prototype and the expenses involved, a simpler fin design (shown clearly in FIG. 3) was utilized. These fins 30 set close to the body of the rocket, are less efficient at stabilizing the rocket 22 than are fins that protrude out into the less turbulent air. Being less efficient, these fins 30 were necessarily made larger than those of a conventional rocket. As such, the fins 30 had a much larger square area. These large fins 30 had a dramatic effect on the flight of the rocket 22.

The first test firing of the prototye took place in a crosswind of approximately 20 km/hr. The launch tube 10 was aimed in the direction of the target and at approximately 70 degrees above the horizon and launched. The rocket 22 responded by turning and flying in the direction of the crosswind. This resulted in the parafoil 54 being deployed upwind of the target. Consequently, the parafoil did not have to fight the crosswind to fly to the target. The inventor had uncovered a very useful phenomenon for deploying parafoils.

The Theory of Operation that the present invention harnessed is known in rocket aeronautics as "weather cocking". Weather cocking is a generally unwanted force that causes a rocket to veer from a ballistic trajectory and into any wind it encounters during its flight.

Weather Cocking is caused by aerodynamic forces on the rocket. Wind striking the side of the rocket generates a side force (vector) which acts through the Center of Pressure ($C_p$). For stability reasons, the $C_p$ is located aft of the Center of Gravity ($C_g$) of the rocket. The effect of the side force is to rotate the rocket about the $C_g$ until the nose is inclined at an angle to the horizontal. This angle is the effective flow direction. The rotation of the rocket produces a new flight path into the wind. When the new flight path is aligned with the effective flow direction, there is no longer any lift force and the rocket will continue to fly in the new flight direction. An excellant description of the phenomenon of weather cocking can be found at the NASA website at exploration.grc.nasa.gov.

Weather Cocking would ordinarily be a serious drawback for an unguided rocket, however, having a rocket fly into the wind (which it does easily) is a great benefit for deploying a parafoil which has great difficulty flying against a wind. Once the rocket has delivered the parafoil to a position upwind of the target, the parafoil can then fly with the wind to the target, which it does easily.

The weakness of small parafoils as unmanned aerial vehicles has always been their inability to fly against the wind. The present invention resolves this problem. By using the Theory of Weather Cocking, the present invention creates a valuable synergy where the strengths of both the rocket and the parafoil are utilized and the weaknesses of each are overcome.

Operation of the Preferred Embodiment—

To use my UAV system; the operator shoulders the launch tube 10, aims it about 70 degrees above the horizon in the direction of the target and presses the firing switch 12 which completes a circuit through the firing switch wiring 14. This allows a current from the battery (not shown) in the battery holder 16 to pass through the leads 18. This causes the igniter 20 to burn and ignite the rocket motor 25. The stop 21 keeps the rocket 22 in position in the tube 10 until it is fired. Once ignited, the motor 25 expels hot gases out the rocket motor exhaust nozzle 24 which causes the rocket 22 to be forced out of the tube 10. The launch tube 10 keeps the rocket traveling in the direction it is aimed until it builds up enough speed that the fins 30 can aerodynamically stabilize the rocket 22. The fins 30 are of a larger than conventional square area which causes the rocket 22 to weather cock into any wind it encounters during its flight. This is shown in FIG. 7 where the trajectory of the rocket of the present invention 62 is compared to the trajectory of a conventional rocket 64. Another aerodynamic feature 23, first shown in FIG. 2, helps reduce the aerodynamic drag of a blunt nose.

Again in FIG. 7, the wind speed and direction 58 is shown as it effects the trajectory of the rocket of the present invention 62. When the rocket 22 reaches apogee, a timed ejection charge built into the motor 25 ignites and deploys the parafoil 54 at the parafoil ejection site 66. The dramatic effects of the fins 30 that have been designed to cause the rocket 22 to Weather Cock into the wind can be seen by comparing the parafoil ejection site of the present invention 66 with the parafoil ejection site of a conventional rocket 67.

Given the wind speed and direction 58 shown in FIG. 7, a small, lightweight parafoil with a typical top speed of approximately 8-10 mph would follow the path of the parafoil of a conventional rocket 70 and be unable to reach the target 72. Even if the parafoil were flown at the target 72, it would be pushed backward at 5-7 mph and miss the target 72.

The parafoil ejection site of the present invention 66 leaves the parafoil in a position to fly with the wind (shown by the path of the parafoil of the present invention 68). This not only makes it possible for the parafoil to reach the target 72, but allows for potential loiter time over the target 72.

Because the amount of Weather Cocking is a vector addition sum, the greater the wind velocity the more the rocket 22 will turn into the wind. This allows a single fin size to be used for a wide range of wind velocities. Of course if there is little or no wind the rocket will behave just like a conventional rocket. The rocket motor 25 has a specific impulse and thrust curve appropriate for the payload and desired range of the device. The thrust curve of the rocket motor can also be adjusted to cause the rocket 22 to Weather Cock at lower or higher altitudes for varying applications. The rocket motor 25 can be quickly changed with another with a different thrust curve should that be necessary or desirable (such as for extremely high wind velocities or long range targets).

The best mode of carrying out the present invention and harnessing the phenomenon of Weather Cocking therefore is to equip the rocket 22 with fins 30 having sufficient square area to cause the rocket 22 to turn into any wind it encounters during its flight. It will be understood to those skilled in the art of rocket aeronautics that many forces are at work on a rocket during its flight. In addition to the size and shape of the fins and their location; the overall size and shape of the rocket body, the rocket's weight, the thrust (specific impulse) of the rocket motor and the thrust curve of the motor are just some of the factors that must be accounted for when any modifications are made to a rocket. As such, when any rocket is designed as part of the present invention the usual computer simulations and physical experimentation will yield the best results. An excellant reference regarding the aforementioned (entitled: *Wind Caused Instability*) can be found at apogeerockets.com/education/instability . . . .

After the rocket 22 has performed the Weather Cocking maneuver and the ejection charge has separated the payload section 27 from the rocket 22, the folded parafoil 32 is extracted from the parafoil compartment 28. A layer of flameproof wadding 34 protects the parafoil from the hot ejection charge gases.

Once the folded parafoil 32 is out of the parafoil compartment and in the airstream, it inflates and assumes its airfoil shape. This is shown in FIG. 6 where the parafoil is fully deployed and flying. The payload section 27 is hanging from the parafoil 54 by the suspension lines 46. The suspension lines 46 are affixed to the suspension line mounts 44. The control lines 42 are also shown in FIG. 6 where they attach to each outside trailing edge of the parafoil 54. A first control line for controlling drag on a right side of said parafoil 54 and a second control line for controlling drag on a second side of said parafoil 54.

In FIG. 5 the control lines 42 are shown passing through the control line apertures 45 in the aft payload bay bulkhead 47 and terminating at a conventional controller motor 40. The motor 40 receives electronic input, by way of an electrical connection 52, from the radio receiver 50. The antenna 38 for the receiver 50 can also be seen in FIG. 5. A radio transmitter on the ground (not shown) that is tuned to the receiver 50 can input guidance commands to said receiver. As the parafoil glides back to the ground, a radio signal from said transmitter can cause the controller 40 to pull one of the control lines 42 or the other. This creates more aerodynamic drag on the side being pulled, which in turn, causes the parafoil 54 to turn in the direction of the increased drag. This provides a means of controlling the horizontal bearing of the parafoil 54 as it glides back to the ground.

In this embodiment the control commands are generated by an operator on the ground with a radio transmitter (not shown). This can be the same operator who launches the rocket. This embodiment has a payload consisting of a small video camera 36 with a built-in transmitter that transmits video data through the video camera transmitter antenna 39. A receiver on the ground (not shown) picks up the signal which can be displayed on any video monitor (e.g., TV, laptop computer, DVD player, etc.) and viewed live by the operator and/or recorded for later use. This payload is shown as an example. Many different payloads can be carried, as will be discussed in the Ramifications Section below.

CONCLUSION, RAMIFICATIONS AND SCOPE

From the foregoing, it can be seen that the Unmanned Aerial Vehicle system of the present invention can give an operator the ability to aerially scout and interact with a distant location within seconds. Reconnaissance from a few blocks away to a few miles away can be accomplished by a single operator merely by establishing a data link with the rocket payload, then aiming and arming the launch tube and firing the rocket. A unique fin structure allows the operator to aim in the air towards the target without compensating for any ambient wind. The fins are designed to cause the rocket to weather cock and automatically position the rocket for optimum parafoil deployment.

Additionally this invention offers something that few other UAV systems can: the ability to accurately and gently place sensors at remote and even hostile locations. The few other systems that can provide this benefit do so at a much higher cost. The present invention is without question the lowest cost UAV system available. It integrates the lowest cost method of getting a payload to altitude; a rocket, with the lowest cost method of flying and landing; a parafoil. Not only is it the lowest cost method of getting a payload in the air, it is also the fastest. The preferred embodiment is so cost effective it is literally disposable.

The present invention requires the least amount of training for the operator. The parafoil is such an inherently stable aircraft that the operator need only move a controller joystick left to turn left or right to turn right. The parafoil is immune to stalling and no operator input can cause a parafoil to crash absent some extreme external force. The operation of the present invention is so simple that the instructions for its use could easily be printed on the launch tube. The parafoil is so inherently stable it can be flown even at night without avionics.

Until now the use of UAV's has been limited largely to the military. High costs and the need for highly trained personnel have largely excluded other agencies and organizations. With the present invention, police, news crews, rescue personnel, firefighters and many others could reasonably afford to have UAV's at their service.

With such diverse possible demands and uses, it can be anticipated that many embodiments of the present invention would evolve. For example, the launch tube 10 of the present invention might be replaced with an alternate launch means such as a conventional lug and rail system. In this embodiment, a lug (or lugs) are attached to the rocket 10 and hold the rocket to a rail until the rocket builds up enough speed for the fins 30 to aerodynamically stabilize the rocket. There are many commercially available versions of this system and many have the ability to aim the rail in the direction of a target.

A suitable pack for such a launch means is certainly within the abilities of those skilled in the art.

The flameproof wadding 34 that protects the folded parafoil 32 from the hot ejection charge gases could be replaced with an alternative means of protecting the folded parafoil such as a piston that is often used in high powered model rockets. Another means for protecting the folded parafoil 32 could be a deployment bag made of protective heat resistant cloth such as "NOMEX™ (a trademark of DuPont Corporation for a manufactured fiber). Deployment bags are also helpful in ensuring an orderly deployment sequence and avoiding tangled suspension lines.

Certainly production embodiments of the present invention would not likely use the fixed-fins of the prototype; but would, as previously mentioned, employ a means for folding the fins close to the body of the rocket 22 and have them spring into flight position on hinges as the rocket 22 exits the launch tube 10. This is common practice for modern shoulder-launched rockets and is well known to those skilled in the art.

Because of the rough handling and extreme environments associated with military use (and others), means for making the present invention weatherproof and more rugged would certainly be required of some embodiments of the system. A means of igniting the rocket motor 25 with a conventional percussion ignition system would likely be one such feature. End caps for each end of the launch tube 10 would likely be another.

Some obvious advantages of the present invention are:

(1) very little set-up time
(2) no assembly
(3) little or no operator training
(4) at high altitude in seconds
(5) small, lightweight and transportable by one person
(6) operable by one person
(7) flies slowly and lands gently enough to place sensors
(8) lands anywhere without specialized retrieval systems
(9) far less expensive than any other UAV with comparable abilities
(10) needs no avionics for nighttime use Although the above description contains many specificities, these should not be construed as limiting the scope of the invention, but as illustrative of some of the presently preferred embodiments thereof. Accordingly the scope of the invention should be determined not by the embodiments illustrated, but by the appended claims and their legal equivalents.

I claim:

1. An unmanned aerial vehicle system comprising;

(a) a rocket having fins that cause said rocket to turn into any wind said rocket encounters during flight;
(b) a separable payload section of said rocket;
(c) a parafoil mechanically coupled to said payload section by a plurality of suspension lines;
(d) a compartment of said rocket for containing said parafoil;
(e) a control line for controlling the drag on a right side of said parafoil and a control line for controlling the drag on a second side of said parafoil, both of said control lines being coupled to a controller motor in said payload section said motor for pulling at once one or the other of said control lines;
(f) a radio receiver in said payload section for input of guidance commands to said radio receiver;
(g) a ground-based radio transmitter for input of guidance commands to said radio receiver;
(h) a rocket motor for propelling said rocket, said rocket motor having a timed ejection charge for separating said payload section from said rocket;
(i) a launch tube internally dimensioned to receive said rocket therein;
(j) an ignition means for igniting said rocket motor, said means being affixed to said launch tube.

2. The unmanned aerial vehicle system of claim 1, wherein said launch tube has a length of less than or equal to six feet and a diameter of less than or equal to eighteen inches.

3. The unmanned aerial vehicle system of claim 1, wherein said ignition means is a switch connected to a battery in a battery holder by firing switch wiring which in turn is connected to an igniter by electrical leads.

4. The unmanned aerial vehicle system of claim 1, wherein said ignition means is a percussion ignition system.

5. The unmanned aerial vehicle system of claim 1, further including within said payload section a video camera having a built-in transmitter that transmits video data to a receiver on the ground.

* * * * *